US010667051B2

(12) United States Patent
Stahl

(10) Patent No.: US 10,667,051 B2
(45) Date of Patent: May 26, 2020

(54) METHODS AND APPARATUS FOR LIMITING THE EXCURSION OF A TRANSDUCER

(71) Applicant: Cirrus Logic International Semiconductor Ltd., Edinburgh (GB)

(72) Inventor: Carl Lennart Stahl, Malmö (SE)

(73) Assignee: Cirrus Logic, Inc., Austin, TX (US)

( * ) Notice: Subject to any disclaimer, the term of this patent is extended or adjusted under 35 U.S.C. 154(b) by 0 days.

(21) Appl. No.: 16/223,904

(22) Filed: Dec. 18, 2018

(65) Prior Publication Data

US 2019/0297418 A1 Sep. 26, 2019

Related U.S. Application Data

(60) Provisional application No. 62/648,160, filed on Mar. 26, 2018.

(51) Int. Cl.
*H04R 3/00* (2006.01)
*H04R 29/00* (2006.01)

(52) U.S. Cl.
CPC ..... *H04R 3/007* (2013.01); *H04R 29/001* (2013.01); *H04R 2400/03* (2013.01)

(58) Field of Classification Search
CPC ... H04R 3/007; H04R 29/001; H04R 2400/03
See application file for complete search history.

(56) References Cited

U.S. PATENT DOCUMENTS 5,857,986 A 1/1999 Moriyasu
6,388,520 B2 5/2002 Wada et al.
6,683,437 B2 1/2004 Tierling
6,703,550 B2 3/2004 Chu
6,762,745 B1 7/2004 Braun et al.
(Continued)

FOREIGN PATENT DOCUMENTS

AU 2002347829 4/2003
EP 0784844 B1 6/2005
(Continued)

OTHER PUBLICATIONS

International Search Report and Written Opinion of the International Searching Authority, International Application No. PCT/GB2019/050964, dated Sep. 3, 2019.

*Primary Examiner* — Regina N Holder
(74) *Attorney, Agent, or Firm* — Jackson Walker L.L.P.

(57) ABSTRACT

Embodiments described herein relate to methods and apparatus for limiting the excursion of a transducer. The method comprises receiving a transducer signal; and limiting the transducer signal or a signal derived therefrom to generate a limited transducer signal for input into the transducer such that an electrical response caused by the limited transducer signal in an electrical model of the transducer would be less than a threshold electrical response, wherein the threshold electrical response has been determined by: inputting a stimulus input signal into the electrical model of the transducer, wherein the stimulus input signal is designed to cause the transducer to reach a maximum excursion; and determining the threshold electrical response as a maximum of the electrical response caused by the stimulus input signal in the electrical model of the transducer.

25 Claims, 5 Drawing Sheets

(56) References Cited

U.S. PATENT DOCUMENTS

| | | | |
|---|---|---|---|
| 6,906,697 | B2 | 6/2005 | Rosenberg |
| 7,154,470 | B2 | 12/2006 | Tierling |
| 7,623,114 | B2 | 11/2009 | Rank |
| 7,639,232 | B2 | 12/2009 | Grant et al. |
| 7,791,588 | B2 | 9/2010 | Tierling et al. |
| 7,979,146 | B2 | 7/2011 | Ulrich et al. |
| 8,068,025 | B2 | 11/2011 | Devenyi et al. |
| 8,098,234 | B2 | 1/2012 | Lacroix et al. |
| 8,102,364 | B2 | 1/2012 | Tierling |
| 8,325,144 | B1 | 12/2012 | Tierling et al. |
| 8,427,286 | B2 | 4/2013 | Grant et al. |
| 8,466,778 | B2 | 6/2013 | Hwang et al. |
| 8,572,293 | B2 | 10/2013 | Cruz-Hernandez et al. |
| 8,593,269 | B2 | 11/2013 | Grant et al. |
| 8,648,829 | B2 | 2/2014 | Shahoian et al. |
| 8,754,757 | B1 | 6/2014 | Ullrich et al. |
| 8,947,216 | B2 | 2/2015 | Da Costa et al. |
| 8,981,915 | B2 | 3/2015 | Bimbaum et al. |
| 8,994,518 | B2 | 3/2015 | Gregorio et al. |
| 9,030,428 | B2 | 5/2015 | Fleming |
| 9,063,570 | B2 | 6/2015 | Weddle et al. |
| 9,083,821 | B2 | 7/2015 | Hughes |
| 9,092,059 | B2 | 7/2015 | Bhatia |
| 9,117,347 | B2 | 8/2015 | Matthews |
| 9,128,523 | B2 | 9/2015 | Buuck et al. |
| 9,164,587 | B2 | 10/2015 | Da Costa et al. |
| 9,196,135 | B2 | 11/2015 | Shah et al. |
| 9,248,840 | B2 | 2/2016 | Truong |
| 9,354,704 | B2 | 5/2016 | Lacroix et al. |
| 9,368,005 | B2 | 6/2016 | Cruz-Hernandez et al. |
| 9,489,047 | B2 | 11/2016 | Jiang et al. |
| 9,507,423 | B2 | 11/2016 | Gandhi et al. |
| 9,513,709 | B2 | 12/2016 | Gregorio et al. |
| 9,588,586 | B2 | 3/2017 | Rihn |
| 9,640,047 | B2 | 5/2017 | Choi et al. |
| 9,652,041 | B2 | 5/2017 | Jiang et al. |
| 9,842,476 | B2 | 12/2017 | Rihn et al. |
| 9,864,567 | B2 | 1/2018 | Seo |
| 9,881,467 | B2 | 1/2018 | Levesque |
| 9,946,348 | B2 | 4/2018 | Saboune et al. |
| 9,959,744 | B2 | 5/2018 | Koskan et al. |
| 10,055,950 | B2 | 8/2018 | Bhatia et al. |
| 10,074,246 | B2 | 9/2018 | Da Costa et al. |
| 10,175,763 | B2 | 1/2019 | Shah |
| 2003/0068053 | A1 | 4/2003 | Chu |
| 2008/0293453 | A1 | 11/2008 | Atlas et al. |
| 2009/0079690 | A1 | 3/2009 | Watson et al. |
| 2009/0088220 | A1 | 4/2009 | Persson |
| 2012/0306631 | A1 | 12/2012 | Hughes |
| 2014/0056461 | A1 | 2/2014 | Afshar |
| 2014/0292501 | A1 | 10/2014 | Lim et al. |
| 2014/0340209 | A1 | 11/2014 | Lacroix et al. |
| 2015/0084752 | A1 | 3/2015 | Heubel et al. |
| 2016/0074278 | A1 | 3/2016 | Muench et al. |
| 2016/0179203 | A1 | 6/2016 | Modarres et al. |
| 2016/0246378 | A1 | 8/2016 | Sampanes et al. |
| 2017/0078804 | A1 | 3/2017 | Guo et al. |
| 2018/0084362 | A1 | 3/2018 | Zhang et al. |
| 2018/0151036 | A1 | 5/2018 | Cha et al. |
| 2018/0160227 | A1* | 6/2018 | Lawrence ..... H04R 3/002 |
| 2018/0237033 | A1 | 8/2018 | Hakeem et al. |
| 2018/0321748 | A1* | 11/2018 | Rao ..... G06F 3/016 |
| 2018/0367897 | A1* | 12/2018 | Bjork ..... G01K 7/16 |
| 2019/0227628 | A1 | 1/2019 | Rand et al. |
| 2019/0114496 | A1 | 8/2019 | Lesso |
| 2019/0294247 | A1 | 9/2019 | Hu et al. |
| 2019/0296674 | A1 | 9/2019 | Janko et al. |
| 2019/0311590 | A1 | 10/2019 | Doy et al. |

FOREIGN PATENT DOCUMENTS

| | | | |
|---|---|---|---|
| EP | 2846218 | A2 | 3/2015 |
| EP | 3379382 | A1 | 9/2018 |
| IN | 201747044027 | | 8/2018 |
| JP | H02130433 | B2 | 5/1990 |
| JP | 6026751 | B2 | 11/2016 |
| JP | 6250985 | | 12/2017 |
| JP | 6321351 | | 5/2018 |
| KR | 20120126446 | A | 11/2012 |
| WO | 2018053159 | A1 | 3/2018 |

* cited by examiner

METHODS AND APPARATUS FOR LIMITING THE EXCURSION OF A TRANSDUCER

TECHNICAL FIELD

Embodiments described herein relate to methods and apparatus for providing excursion protection for a transducer. In particular, methods and apparatus described herein make use of a stimulus input signal designed to cause the transducer to reach a maximum excursion.

BACKGROUND

Linear Resonant Actuators (LRAs) are devices which may be used to stimulate the vibro-tactile sensing system of the human body in order to elicit touch sensations programmatically. The Pacini neuron in the human tactile system is particularly sensitive to vibrations of a frequency within the range 100 Hz to 400 Hz. LRAs may be used to stimulate the tactile system directly through controlled vibrations. These vibrations may be achieved by applying an electromechanical force to a small mass held by a spring, or set of springs. The electromechanical force may be elicited by applying an input voltage (usually oscillatory) to the LRA which makes the inner mass of the LRA move.

FIG. 1 illustrates an example of a haptic transducer 100. The moving mass 102 is centred in a rest position by a pair of springs 104*a* and 104*b*. The moving mass 102 comprises one or more permanent magnets 106*a* sand 106*b* embedded within it, and one or more coils of wire 108 may apply electromagnetic force to the magnets, thereby moving the moving mass 102 from the rest position, usually in an oscillatory manner. It will be appreciated that FIG. 1 illustrates a basic configuration of a haptic transducer 100, and multiple-magnet and/or multiple-coil configurations are all available. The current applied to the coil 108 moves the moving mass 102 with respect to a housing of the haptic transducer 100. The moving mass 102 may then vibrate within the housing, and stops 110*a* and 110*b* limit the excursion of the moving mass 102 from the rest position. The stops 110*a* and 110*b* may therefore limit spring damage if the driving force is too high.

FIG. 2 illustrates an example of a control system 200 for controlling the driving signal applied to a haptic transducer 201. The voltage and current across the terminals of the haptic transducer may be measured, and a haptic waveform generator 202 may monitor the measured voltage and current signals in order to drive the LRA to a desired motion.

The haptic transducer 201 may have limited available excursion within the housing until it hits the stops. Hitting the stops may generate an unwanted haptic or audible response, and may also cause damage to the haptic transducer 201 especially if repeated several times. There may therefore be a need for controlling the maximum excursion inside a haptic transducer. In other transducers, similar problems, such as for example with micro loudspeaker protection, the excursion may be measured directly by use of a laser. However, particularly for haptic transducers, but potentially in scenarios where the use of a laser is either unsuitable or undesirable for economic reasons or otherwise, it may not be possible to measure the excursion of the transducer directly.

For haptic transducers, it may be possible to open the housing enough to be able to measure the movement of the mass with a laser. However, the process is not only difficult to perform, but even when successful, a change in the system is observed due to the modifications caused by physically opening the casing. Furthermore, it is not a feasible way to approach a distribution of produced haptic transducers as the measurement may have to be performed on a statistical set of the component. A modified component, in which the casing has been opened, cannot usually be mounted in the actual end product, making the measurement by using a laser a difficult way to tune the haptic transducers in the development of a larger product such as a mobile phone.

SUMMARY

According to embodiments described herein there is provided a method of providing excursion protection for a transducer. The method comprises receiving a transducer signal; and limiting the transducer signal, or a signal derived therefrom, to generate a limited transducer signal for driving the transducer such that an electrical response caused by the limited transducer signal in an electrical model of the transducer would be less than a threshold electrical response, wherein the threshold electrical response has been determined by: inputting a stimulus input signal into the electrical model of the transducer, wherein the stimulus input signal is designed to cause the transducer to reach a maximum excursion; and determining the threshold electrical response as a maximum of the electrical response caused by the stimulus input signal in the electrical model of the transducer.

According to some embodiments there is provided a controller for providing excursion protection for a transducer. The controller comprises an input configured to receive a transducer signal; excursion limiting circuitry configured to limit the transducer signal or a signal derived therefrom to generate a limited transducer signal for driving the transducer such that an electrical response caused by the limited transducer signal in an electrical model of the transducer would be less than a threshold electrical response, wherein the threshold electrical response has been determined by: inputting a stimulus input signal into the electrical model of the transducer, wherein the stimulus input signal is designed to cause the transducer to reach a maximum excursion; and determining the threshold electrical response as a maximum of the electrical response caused by the stimulus input signal in the electrical model of the transducer.

BRIEF DESCRIPTION OF THE DRAWINGS

For a better understanding of the embodiments of the present disclosure, and to show how it may be put into effect, reference will now be made, by way of example only, to the accompanying drawings, in which:—

DESCRIPTION

The description below sets forth example embodiments according to this disclosure. Further example embodiments and implementations will be apparent to those having ordinary skill in the art. Further, those having ordinary skill in the art will recognize that various equivalent techniques may be applied in lieu of, or in conjunction with, the embodiment discussed below, and all such equivalents should be deemed as being encompassed by the present disclosure.

Various electronic devices or smart devices may have transducers, speakers, or any acoustic output transducers, for example any transducer for converting a suitable electrical driving signal into an acoustic output such as a sonic pressure wave or mechanical vibration. For example, many electronic devices may include one or more speakers or loudspeakers for sound generation, for example, for playback of audio content, voice communications, and/or for providing audible notifications.

Such speakers or loudspeakers may comprise an electromagnetic actuator, for example a voice coil motor, which is mechanically coupled to a flexible diaphragm, for example a conventional loudspeaker cone, or which is mechanically coupled to a surface of a device, for example the glass screen of a mobile device. Some electronic devices may also include acoustic output transducers capable of generating ultrasonic waves, for example for use in proximity detection type applications and/or machine-to-machine communication.

Many electronic devices may additionally or alternatively include more specialized acoustic output transducers, for example, haptic transducers, tailored for generating vibrations for haptic control feedback or notifications to a user. Additionally or alternatively, an electronic device may have a connector, e.g. a socket, for making a removable mating connection with a corresponding connector of an accessory apparatus and may be arranged to provide a driving signal to the connector so as to drive a transducer, of one or more of the types mentioned above, of the accessory apparatus when connected. Such an electronic device will thus comprise driving circuitry for driving the transducer of the host device or connected accessory with a suitable driving signal.

For acoustic or haptic transducers, the driving signal will generally be an analog time varying voltage signal, for example, a time varying waveform.

As described above, for transducers, in particular haptic transducers although the methods described herein may be equally applied to other types of transducer, knowledge of the excursion of the transducer may be useful for protecting the transducer from damage due to over driving the transducer. In some examples, an electrical model of the transducer system may be used to predict the electrical response of the transducer system.

Figure 1:
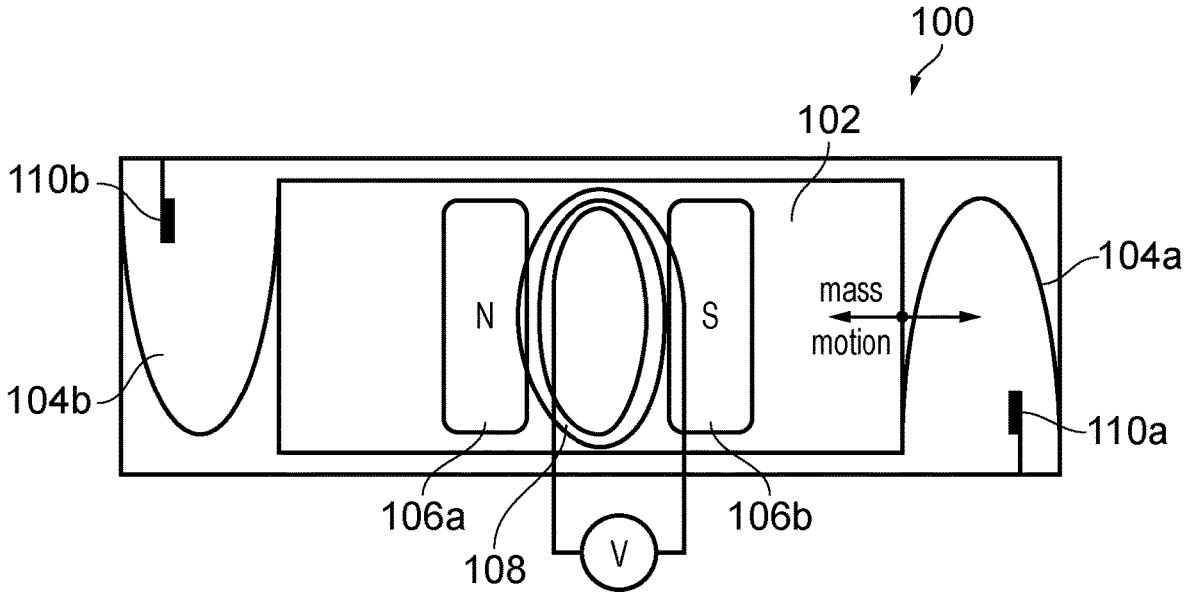
FIG. 1 illustrates an example of a haptic transducer 100.
Figure 2:
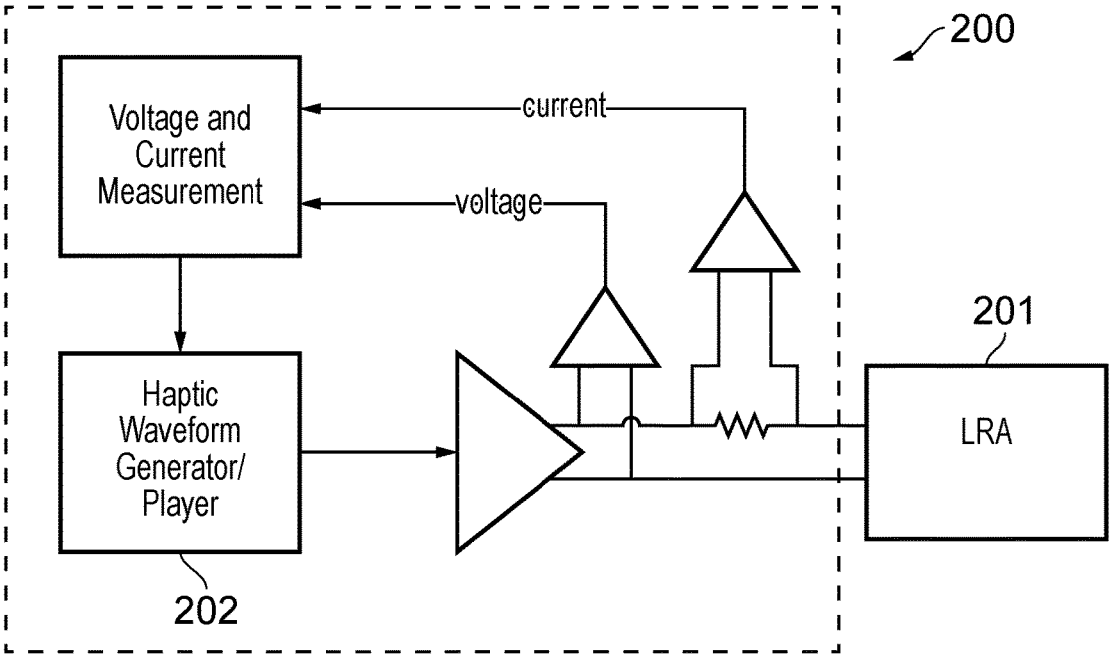
FIG. 2 illustrates an example of a control system for controlling the driving signal applied to a haptic transducer.
Figure 3:
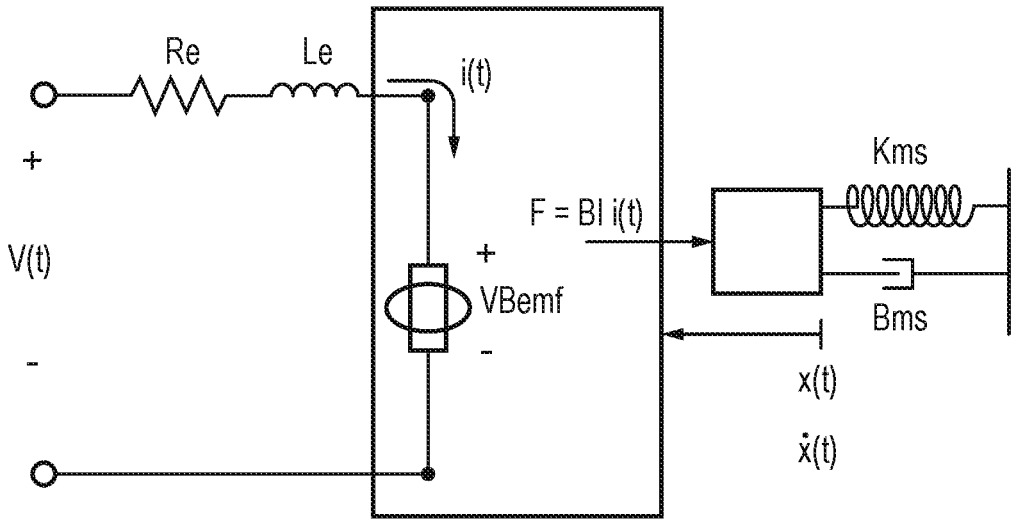
FIG. 3 illustrates an example of a model 300 of a haptic transducer having both electrical and mechanical components.

FIG. 3 illustrates an example of a model 300 of a haptic transducer having both electrical and mechanical components. Haptic transducers, for example, Linear Resonant Actuators (LRAs), are non-linear components that may behave differently depending on, for example, the voltage levels applied, the operating temperature, and the frequency of operation. However, these components may be modelled as linear components within the certain conditions. In this example, the haptic transducer 300 is modelled as a third order system having electrical and mechanical elements.

Figure 4:
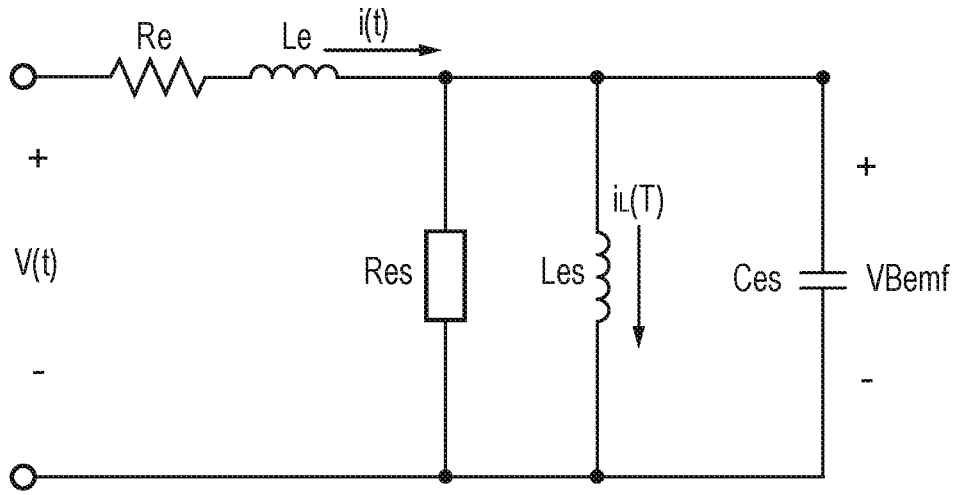
FIG. 4 illustrates a purely electrical model of a haptic transducer.

Alternatively, a haptic transducer may be modelled as a purely electrical circuit as illustrated in FIG. 4, with a resistor Res, inductor Les and capacitor Ces connected in parallel representing the mechanical attributes of the motion of the moving mass in the haptic transducer. The values of Res, Ces and Les may be modelled for each individual haptic transducer. For example, test frequencies may be utilized to determine the value of each parameter (Le, Re, Res, Ces, Les) of the model for a particular haptic transducer.

It will be appreciated that the electrical model illustrated in FIG. 3 is an example electrical model, and that other types of model for a haptic transducer may be used in the embodiments described herein.

The voltage across the capacitor Ces represents the back electromotive force voltage in the transducer, VBemf. This voltage may be modelled as being proportional to the speed of the moving mass in the transducer. The current through the inductor $I_L$ may be modelled as proportional to the position of the moving mass in the transducer, and proportional to the force applied to the moving mass in the transducer.

From the electrical model and from measurements of V(t) and I($t$) across an actual transducer, it may therefore be possible to build a model of the electrical response of the system. However, although the electrical responses of the system are related to the mechanical movement of the system, for example as described above:

$$VBemf(t) = Bl\dot{x}(t), \text{ and } i_L(t) = \frac{F}{Bl},$$

where

VBemf(t) is the voltage across the capacitor Ces representing the back electromotive force voltage in the transducer, $i_L(t)$ is the force factor, $\dot{x}(t)$ is the velocity of the moving mass of the transducer, $i_L(t)$ is the current across the inductor Les, and $i_L(t)$ is the force on the moving mass.

The scaling factor, which in this example comprises a force factor Bl, may not be derivable from the electrical response of the electrical model.

In other words, it may not be possible to predict the actual value of the excursion of the moving mass from the electrical model alone.

Manufacturers of haptic transducers face a similar problem of ensuring that transducers meet a certain excursion in their production line. Similarly, as it is desirable to ensure this excursion of the transducer on a fully assembled unit, it is not possible to make the measurement of the excursion using a laser on the production line.

Therefore, to ensure quality out of production, indirect measurement of the excursion may be resorted to. This indirect measurement may typically be performed by creating a stimulus input signal designed to ensure that the transducer reaches a certain excursion. In particular, the stimulus input signal may be constructed in such a way that individual transducer components having slightly different resonant frequencies within what would be considered a normal range for the type of transducer, are all excited to the certain excursion.

For example, the stimulus input signal may comprise a frequency sweep configured to sweep through a range of expected resonance frequencies for the type of transducer.

For example, the stimulus input signal may comprise a signal at the rate power of the transducer, for example 2 Vrms.

Figure 5A:
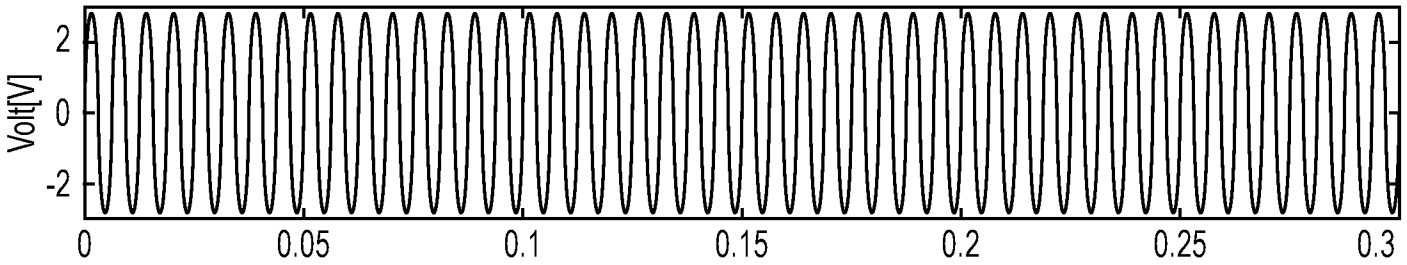
FIGS. 5*a*, 5*b*, and 5*c* illustrate examples of stimulus input signals.
Figure 5B:
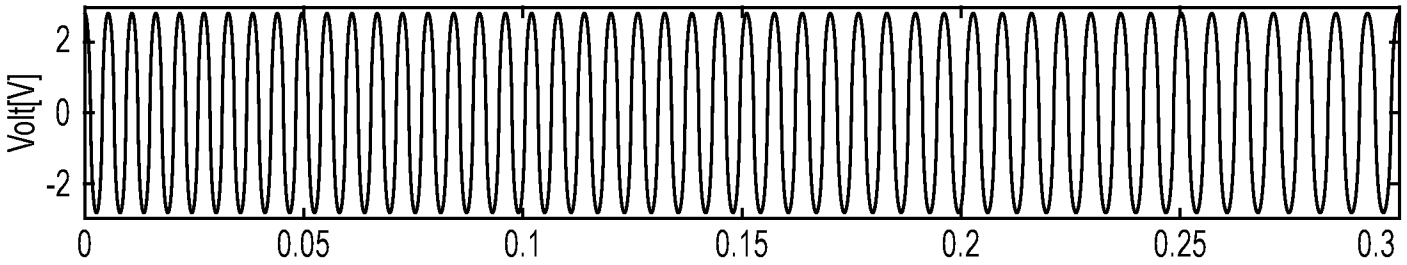
Figure 5C:
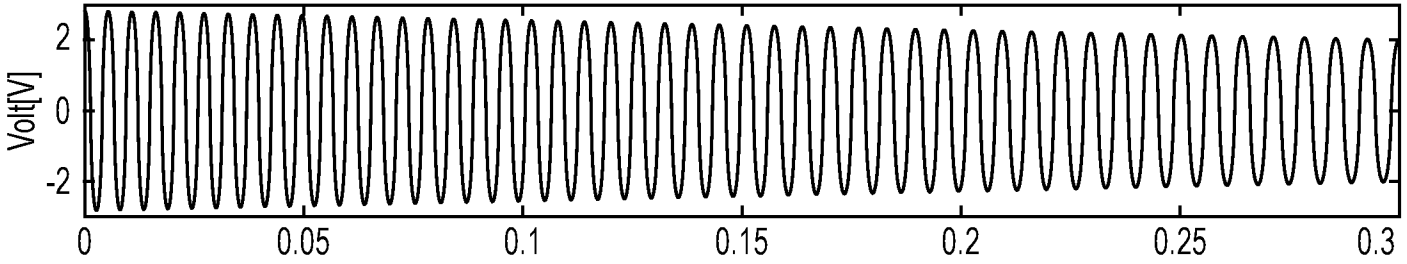

FIGS. 5*a* to 5*c* illustrate examples of stimulus input signals that may be used.

In FIG. 5*a*, the stimulus input signal comprises a 2Vrms signal at a constant frequency. This stimulus input signal may be used when the resonant frequency of the transducer is known.

In FIG. 5*b*, the stimulus input signal comprises a 2Vrms signal at a varying, in this example decreasing frequency. In this example, the frequency is varied from 130 to 190 Hz. The rate of change of the frequency may be slow to ensure that the certain excursion of the transducer is reached for whatever the resonance frequency for the transducer may be in the frequency range 130 to 190 Hz. It will be appreciated that the rate speed of the frequency change is illustrated such that the variation in frequency can be seen, but that slower rates of frequency change may be used.

In FIG. 5*c*, the stimulus input signal has the same variation in frequency as applied in FIG. 5*b*, but the amplitude is lowered at lower frequencies. This lowering of amplitude may ensure a different intensity of stimulus input signal for different frequencies. For example, transducers having lower resonance frequencies may be known to exhibit larger excursions at resonance than those with higher resonance frequencies. Therefore, the amplitude of the signal required to take a transducer with a low resonance frequency to a certain excursion may be less than the amplitude of the signal required to take a transducer with a higher resonance frequency to the same certain excursion.

Figure 6:
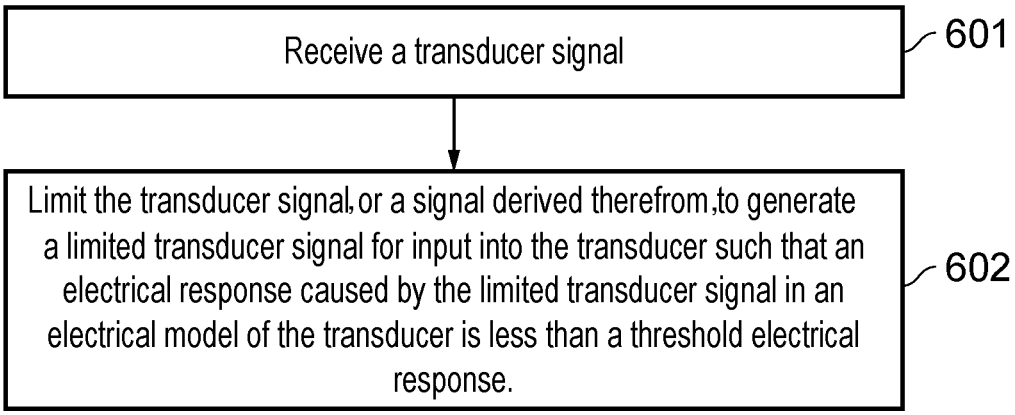
FIG. 6 illustrates a method, in a controller, for providing excursion protection for a transducer in accordance with some embodiments.

FIG. 6 is a flowchart that illustrates a method, in a controller, for providing excursion protection for a transducer.

In step 601, the method comprises receiving a transducer signal.

In step 602, the method comprises limiting the transducer signal or a signal derived therefrom to generate a limited transducer signal for input into the transducer. The transducer signal or signal derived therefrom may be limited such that an electrical response caused by the limited transducer signal in an electrical model of the transducer is less than a threshold electrical response.

The threshold electrical response may be determined by: inputting a stimulus input signal into the electrical model of the transducer, wherein the stimulus input signal is designed to cause the transducer to reach a certain excursion; and determining the threshold electrical response as a maximum of an electrical response caused by a stimulus input signal in the electrical model of the transducer.

In other words, the stimulus input signal utilized to determine the threshold electrical response may be the same stimulus input signal used by a manufacturer to ensure quality out of production as described above, or may be a stimulus input signal expected to produce similar results. The certain excursion may comprise a maximum excursion of the transducer. For example, the certain excursion may comprise the excursion required to hit the stops as described above. Alternatively, the certain excursion may comprise a maximum excursion of the transducer without hitting the stops. The stimulus input signal may therefore have been run in a production line to make sure the haptic transducer actually handles this stimulus input signal without any excursion problems such as hitting the stops. In other words, the stimulus input signal may have already been tested on 100% of the samples.

For example, the stimulus input signal may comprise a nominal resonance frequency associated with the transducer. For example, the nominal resonance frequency may be an expected resonance frequency for the type of transducer, as illustrated for example in FIG. 5*a*.

In some examples, the stimulus input signal comprises a signal in which the frequency is varied across a range of frequencies comprising the nominal resonance frequency, for example as illustrated in FIG. 5*b* or 5*c*. For example, the stimulus input signal may comprise a sweep through a range of expected resonance frequencies for the type of transducer.

In some examples, the electrical response comprises a representation of the back electromotive force, EMF, voltage in the electrical model. For example, the representation of the back EMF in the electrical model may be the voltage across the electrical model of the transducer. This representation of the back EMF voltage may be directly measured in the electrical model of the transducer, as illustrated in FIG. 4.

In examples wherein the electrical response comprises a representation of the back electromotive force, EMF, voltage in the electrical model, the step of limiting may comprise attenuating the transducer signal or the signal derived therefrom such that when the limited transducer signal is input into the electrical model, the representation of the back EMF voltage in the electrical model remains below a maximum of the representation of the back EMF voltage in the electrical model caused by the stimulus input signal.

In some examples, therefore, the step of determining the maximum of the representation of the back EMF voltage comprises measuring the voltage across the electrical model of the moving mass of the transducer as the stimulus input signal is input into the electrical model of the transducer; and setting this maximum voltage as the maximum of the representation of the back EMF voltage caused by the stimulus input signal.

In the example illustrated in FIG. 4, the electrical model of the moving mass of the transducer comprises resistor Res, inductor Les and capacitor Ces connected in parallel.

In some examples the step of limiting comprises setting the maximum of the electrical response caused by the stimulus input signal equal to 1. In other words, for practical reasons, as the value of the actual excursion/velocity is not known, the numbers may be rescaled such that the certain excursion, maximum velocity, and maximum energy are all equal to one (1). This rescaling to one (1) may also result in the variables being in the same Q-format.

In some examples, the electrical response comprises a total energy across the electrical model. The step of limiting therefore comprises attenuating the transducer signal or the signal derived therefrom such that when the limited transducer signal is input into the electrical model, the total energy across the electrical model remains below a maximum of the total energy across the electrical model caused by the stimulus input signal.

In some examples, the electrical response comprises an inductor current in the electrical model. The step of limiting may therefore comprise attenuating the transducer signal or the signal derived therefrom such that when the transducer signal is input into the electrical model, an inductor current, in the electrical model remains below the maximum inductor current in the electrical model caused by the stimulus input signal. The inductor current may be measured across the inductor Les as illustrated in FIG. 4.

In the examples described herein, the methods and apparatus are directed towards excursion protection for a haptic transducer. However, it will be appreciated that the methods and apparatus described herein may be equally applied for excursion protection for any other type of transducer, for example, a micro-speaker.

For example, the electrical model of the transducer may comprise an electrical model of a micro-speaker, if the transducer signal is to be output to a micro-speaker.

Figure 7:
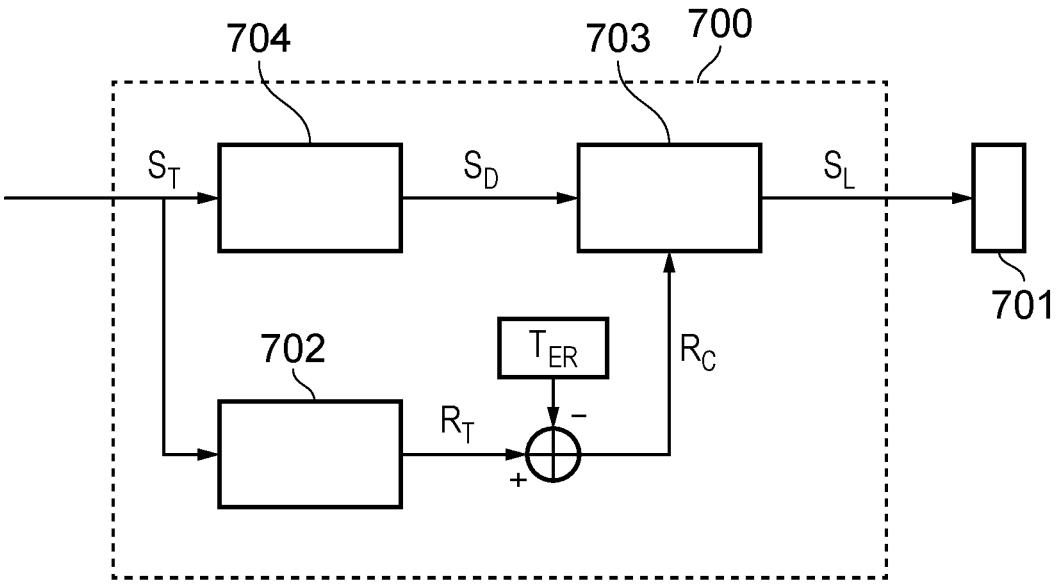
FIG. 7 illustrates a controller in accordance with some embodiments.

FIG. 7 illustrates an example of a controller 700 for providing excursion protection for a transducer 701 in accordance with some embodiments.

The controller 700 comprises an electrical modelling block 702 configured to receive the transducer signal, $S_T$, and to determine an electrical response, $R_T$ caused by the transducer signal in the electrical model of the transducer. The electrical response, $R_T$ may then be compared with the threshold electrical response, $T_{ER}$ in comparison block 703. The comparison block 703 may be configured to subtract the threshold electrical response, $T_{ER}$ from the electrical response $R_T$. The comparison $R_C$ may then be input into an excursion limiting circuitry 703, which may limit a delayed version of the transducer signal $S_D$ based on the comparison $R_C$ to generate the limited transducer signal $S_L$.

In other words, if the comparison indicates that the electrical response $R_T$ is greater than the threshold electrical response $T_{ER}$ by a predetermined amount, the excursion limiting circuitry 703 may be configured to apply attenuation to the delayed transducer signal $S_D$ such that an electrical response caused by the limited transducer signal $S_L$ in the electrical model of the transducer would be less than the threshold electrical response. In other words, the controller 700 may be configured to ensure that the value of $R_C$ is less than or equal to 0.

In some examples, delay circuitry 704 may be configured to delay the transducer signal to generate the delayed transducer signal $S_D$ to introduce delay into the signal path between the transducer signal $S_T$ and the delayed transducer signal $S_D$ that is comparable to the delay in the signal path between the transducer signal $S_T$ and the comparison $R_C$.

As described above, the electrical response $R_T$ may be an inductor current, for example the current through the inductor Les in FIG. 4. The electrical response may also be the back EMF, for example, measured across the Resistor Res, Inductor Les and Capacitor Ces in FIG. 4. The electrical response may also comprise the total energy in the electrical mode, for example $Ces*VBemf^2+Les*i_L(t)^2$ in the electrical model of FIG. 4.

Figure 8:
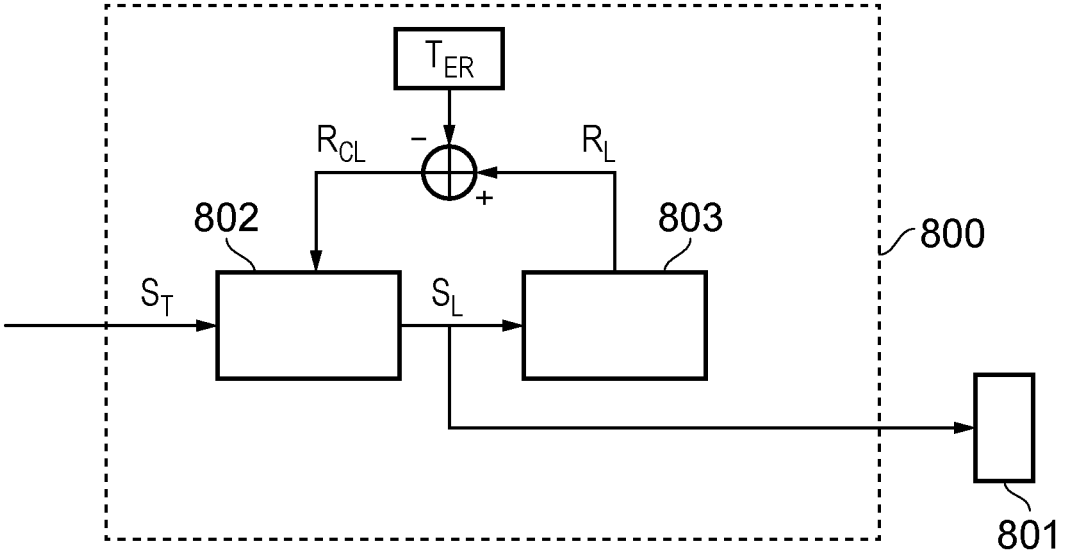
FIG. 8 illustrates a controller in accordance with some embodiments.

FIG. 8 illustrates an example controller 800 for providing excursion protection for a transducer 801 in accordance with some embodiments.

The controller 800 comprises an excursion limiting circuitry 802, configured to attenuate the transducer signal $S_T$ to generate the limited transducer signal $S_L$ for input into the transducer 801.

The controller 800 further comprises an electrical modelling block 803 configured to receive the limited transducer signal $S_L$ and to determine an electrical response $R_L$ caused by the limited transducer signal in the electrical model of the transducer.

The electrical response, $R_L$ may then be compared with the threshold electrical response, $T_{ER}$ in comparison block 804. The comparison block 804 may be configured to subtract the threshold electrical response, $T_{ER}$ from the electrical response $R_L$. The comparison $R_{CL}$ may then be input into the excursion limiting circuitry 802, which may adjust the limitation of the transducer signal $S_T$ based on the comparison $R_{CL}$.

In other words, if the comparison $R_{CL}$ indicates that the electrical response $R_L$ is greater than the threshold electrical response $T_{ER}$ by a predetermined amount, the excursion limiting circuitry 802 may be configured to apply more attenuation to the transducer signal $S_T$ such that an electrical response caused by the limited transducer signal $S_L$ in the electrical model of the transducer would be less than the threshold electrical response. In other words, the controller 800 may be configured to ensure that the value of $R_C$ is less than or equal to 0.

As described above, the electrical response may be an inductor current, for example the current through the inductor Les in FIG. 4. The electrical response may also be the back EMF, for example, measured across the Resistor Res, Inductor Les and Capacitor Ces in FIG. 4. The electrical response may also comprise the total energy in the electrical mode, for example $Ces*VBemf^2+Les*i_L(t)^2$ in the electrical model of FIG. 4. It should be noted that the above-mentioned embodiments illustrate rather than limit the invention, and that those skilled in the art will be able to design many alternative embodiments without departing from the scope of the appended claims. The word "comprising" does not exclude the presence of elements or steps other than those listed in the claim, "a" or "an" does not exclude a plurality, and a single feature or other unit may fulfill the functions of several units recited in the claims. Any reference numerals or labels in the claims shall not be construed so as to limit their scope. Terms such as amplify or gain include possible applying a scaling factor or less than unity to a signal.

It will of course be appreciated that various embodiments of the analog conditioning circuit as described above or various blocks or parts thereof may be co-integrated with other blocks or parts thereof or with other functions of a host device on an integrated circuit such as a Smart Codec.

The skilled person will thus recognize that some aspects of the above-described apparatus and methods may be embodied as processor control code, for example on a non-volatile carrier medium such as a disk, CD- or DVD-ROM, programmed memory such as read only memory (Firmware), or on a data carrier such as an optical or electrical signal carrier. For many applications embodiments of the invention will be implemented on a DSP (Digital Signal Processor), ASIC (Application Specific Integrated Circuit) or FPGA (Field Programmable Gate Array). Thus, the code may comprise conventional program code or microcode or, for example code for setting up or controlling an ASIC or FPGA. The code may also comprise code for dynamically configuring re-configurable apparatus such as re-programmable logic gate arrays. Similarly, the code may comprise code for a hardware description language such as Verilog™ or VHDL (Very high speed integrated circuit Hardware Description Language). As the skilled person will appreciate, the code may be distributed between a plurality of coupled components in communication with one another. Where appropriate, the embodiments may also be implemented using code running on a field-(re)programmable analog array or similar device in order to configure analogue hardware.

It should be understood—especially by those having ordinary skill in the art with the benefit of this disclosure—that the various operations described herein, particularly in connection with the figures, may be implemented by other circuitry or other hardware components. The order in which each operation of a given method is performed may be changed, and various elements of the systems illustrated herein may be added, reordered, combined, omitted, modified, etc. It is intended that this disclosure embrace all such modifications and changes and, accordingly, the above description should be regarded in an illustrative rather than a restrictive sense.

Similarly, although this disclosure makes reference to specific embodiments, certain modifications and changes can be made to those embodiments without departing from the scope and coverage of this disclosure. Moreover, any benefits, advantages, or solution to problems that are described herein with regard to specific embodiments are not intended to be construed as a critical, required, or essential feature of element.

Further embodiments likewise, with the benefit of this disclosure, will be apparent to those having ordinary skill in the art, and such embodiments should be deemed as being encompasses herein.

The invention claimed is:

1. A method of providing excursion protection for a transducer comprising:

receiving a transducer signal; and limiting the transducer signal, or a signal derived therefrom, to generate a limited transducer signal for driving the transducer such that an electrical response caused by the limited transducer signal in an electrical model of the transducer would be less than a threshold electrical response, wherein the threshold electrical response has been determined by:

inputting a stimulus input signal into the electrical model of the transducer, wherein the stimulus input signal is designed to cause the transducer to reach a maximum excursion; and determining the threshold electrical response as a maximum of the electrical response caused by the stimulus input signal in the electrical model of the transducer.

2. The method of claim 1 further comprising:

determining an electrical response caused by the transducer signal in the electrical model of the transducer; and limiting a delayed version of the transducer signal to generate the limited transducer signal based on a comparison of the electrical response caused by the transducer signal with the threshold electrical response.

3. The method of claim 1 further comprising:

determining an electrical response caused by the limited transducer signal in the electrical model of the transducer;

comparing the electrical response of the limited transducer signal with the threshold electrical response; and adjusting the limitation of the transducer signal based on the comparison.

4. The method of claim 1 wherein the electrical response comprises a representation of the back electromotive force, EMF, voltage in the electrical model.

5. The method of claim 4 wherein the step of limiting comprises:

attenuating the transducer signal or the signal derived therefrom to generate the limited transducer signal, such that when the limited transducer signal is input into the electrical model, the representation of the back EMF voltage in the electrical model remains below a maximum of the representation of the back EMF voltage in the electrical model caused by the stimulus input signal.

6. The method of claim 5 wherein the step of limiting comprises:

setting the maximum of the representation of the back EMF voltage equal to 1.

7. The method of claim 5 wherein the transducer comprises a Linear Resonant Actuator, LRA, and wherein the electrical model comprises an electrical model of a moving mass of the transducer, and wherein the step of determining the maximum back EMF voltage comprises:

measuring the voltage across the electrical model of the moving mass of the transducer as the stimulus input signal is input into the electrical model of the transducer; and setting the maximum voltage reached in the step of measuring as the maximum back EMF voltage caused by the stimulus input signal.

8. The method as claimed in claim 1 wherein the electrical response comprises a total energy across the electrical model.

9. The method of claim 8 wherein the step of limiting comprises:

attenuating the transducer signal or the signal derived therefrom to generate the limited transducer signal such that when the limited transducer signal is input into the electrical model, the total energy across the electrical model remains below a maximum of the total energy across the electrical model caused by the stimulus input signal.

10. The method of claim 1 wherein the electrical response comprises an inductor current in the electrical model.

11. The method of claim 10 wherein the step of limiting comprises attenuating the transducer signal or the signal derived therefrom to generate the limited transducer signal such that when the limited transducer signal is input into the electrical model, an inductor current in the electrical model remains below the maximum inductor current in the electrical model caused by the stimulus input signal.

12. The method of claim 1 wherein the stimulus input signal comprises a nominal resonance frequency associated with the transducer.

13. The method of claim 12 wherein the stimulus input signal comprises a signal in which the frequency is varied across a range of frequencies comprising the nominal resonance frequency.

14. A controller for providing excursion protection for a transducer comprising:

an input configured to receive a transducer signal;

excursion limiting circuitry configured to limit the transducer signal or a signal derived therefrom to generate a limited transducer signal for driving the transducer such that an electrical response caused by the limited transducer signal in an electrical model of the transducer would be less than a threshold electrical response, wherein the threshold electrical response has been determined by:

inputting a stimulus input signal into the electrical model of the transducer, wherein the stimulus input signal is designed to cause the transducer to reach a maximum excursion; and determining the threshold electrical response as a maximum of the electrical response caused by the stimulus input signal in the electrical model of the transducer.

15. The controller of claim 14 further comprising:

an electrical modelling block configured to determine an electrical response caused by the transducer signal in the electrical model of the transducer; wherein the excursion limiting circuitry is configured to limit a delayed version of the transducer signal to generate the limited transducer signal based on a comparison of the electrical response caused by the transducer signal with the threshold electrical response.

16. The controller of claim 14 further comprising:

an electrical modelling block configured to determine an electrical response caused by the limited transducer signal in the electrical model of the transducer;

a comparison block configured to compare the electrical response of the limited transducer signal to the threshold electrical response; wherein the excursion limiting circuitry is configured to adjust the limitation of the transducer signal based on the comparison.

17. The controller of claim 14 wherein the electrical response comprises a representation of the back electromotive force, EMF, voltage in the electrical model.

18. The controller of claim 17 wherein the excursion limiting circuitry is configured to:

attenuate the transducer signal or the signal derived therefrom to generate the limited transducer signal, such that when the limited transducer signal is input into the electrical model, the representation of the back EMF voltage in the electrical model remains below a maximum of the representation of the back EMF voltage in the electrical model caused by the stimulus input signal.

19. The controller of claim 18 wherein the excursion limiting circuitry is configured to:

set the maximum of the representation of the back EMF voltage equal to 1.

20. The controller of claim 14 wherein the electrical response comprises a total energy across the electrical model.

21. The controller of claim 20 wherein excursion limiting circuitry is configured to:

attenuate the transducer signal or the signal derived therefrom to generate the limited transducer signal such that when the limited transducer signal is input into the electrical model, the total energy across the electrical model remains below a maximum of the total energy across the electrical model caused by the stimulus input signal.

22. The controller of claim 14 wherein the electrical response comprises an inductor current in the electrical model.

23. The controller of claim 22 wherein the excursion limiting circuitry is configured to: attenuate the transducer signal or the signal derived therefrom to generate the limited transducer signal such that when the limited transducer signal is input into the electrical model, an inductor current in the electrical model remains below the maximum inductor current in the electrical model caused by the stimulus input signal.

24. The controller of claim 14 wherein the stimulus input signal comprises a nominal resonance frequency associated with the transducer.

25. The controller of claim 24 wherein the stimulus input signal comprises a signal in which the frequency is varied across a range of frequencies comprising the nominal resonance frequency.

* * * * *